United States Patent [19]

Mackintosh

[11] Patent Number: 4,909,000

[45] Date of Patent: Mar. 20, 1990

[54] FOLDING GRANDSTAND

[75] Inventor: Charles Mackintosh, Los Angeles, Calif.

[73] Assignee: Rollway Grandstand Corporation, Los Angeles, Calif.

[21] Appl. No.: 279,107

[22] Filed: Dec. 2, 1988

[51] Int. Cl.[4] ..... E04H 3/12

[52] U.S. Cl. ..... 52/9

[58] Field of Search ..... 52/9, 10

[56] References Cited

U.S. PATENT DOCUMENTS 882,721 3/1908 Soss .
1,619,502 6/1925 Fox .
2,663,913 10/1949 Mackintosh .
2,663,914 12/1949 Mackintosh .
2,817,121 10/1951 Mackintosh .
3,209,390 7/1963 Bassan .

*Primary Examiner*—Carl D. Friedman

*Attorney, Agent, or Firm*—Watson, Cole, Grindle & Watson

[57] ABSTRACT

A folding grandstand has at least forward and rearward frame sections hinged together at their adjacent ends by link hinge assemblies recessed below the deck surfaces of the sections, and comprising a pair of crossing link arms hinged at opposite ends to the respective sections.

2 Claims, 2 Drawing Sheets

11
12
13
14
15
16
17
18
19
21
22
23
24
25
26
27
28
29
31
32
34
35
36
37
38
39
40
41
42
43
44
44a
45
46
47
48
49
50
51
53

FOLDING GRANDSTAND

BACKGROUND OF THE INVENTION

This invention relates generally to folding grandstands or bleachers, and more particularly to stands of the type which comprise hinged or pivoted frames carrying seats and foot boards and adapted to assume a sloping or inclined position when opened for use or occupancy, but capable of being folded together to vertical positions to occupy a minimum of floor space when collapsed.

Folding grandstands of this general type usually comprise two or more supporting frame sections horizontally hinged together at their adjacent ends by the provision of hinge assemblies between frame sections to facilitate a folding together of the sections in a fanfold manner. In a grandstand having three hinged sections, portions of the hinge assemblies between the rearward and next adjacent sections typically extend above the deck surface of the grandstand. Likewise, for grandstands having four hinged sections, portions of the hinge assemblies between the forward most and next adjacent sections extend upwardly of the deck surface. Because the link arms of these hinge assemblies must be lubricated, they are often times covered to avoid contact by the seat occupants. More importantly, the hinge assemblies must be away from the end aisles or intermediate aisles of the grandstand to minimize interference with seat occupants during seating.

SUMMARY OF THE INVENTION

It is therefore an object of the present invention to provide a folding grandstand having recessed hinge assemblies lying wholly below the deck sections of horizontally hinged grandstand sections to thereby avoid the aforementioned problems experienced with prior folding grandstands of this general type.

A supporting frame of the folding grandstand comprises at least a forward and rearward section horizontally hinged together at adjacent ends, the frame being adapted when opened for use to occupy a plane of gradual inclination to the horizontal. The forward section may be supported at its forward end on a ground surface, or the upper end of the rearward section may be hingedly connected to an upstanding wall. The hinge assemblies interconnecting the forward and rearward sections include a pair of flat hinge plates fixed to the sections with each of the plates having an elongated slot lying parallel to the sections. A pair of crossed lever arms are each hingedly connected at one end thereof to the respective sections, an opposite end of each of the arms is pivotally connected to an opposing plate for sliding movement along its slot upon the folding of the sections, and the arms are pivotally interconnected intermediate their ends.

Other objects, advantages and novel features of the invention will become more apparent from the following detailed description of the invention.

BRIEF DESCRIPTION OF THE DRAWINGS

FIG. 4 is a view similar to FIG. 3 showing, at an enlarged scale, the link hinge assembly in the folded condition of the grandstand.

DETAILED DESCRIPTION OF THE INVENTION

Figure 5:
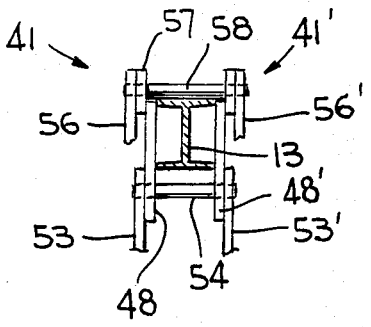
FIG. 5 is a sectional view taken substantially along the line 5—5 of FIG. 4.

Turning now to the drawings wherein like reference characters refer to like and corresponding parts throughout the several views, the stand 10 comprises at least two sections, a forward or lower section 11, and a rearward or upper section 12. Each section comprises spaced longitudinal beams 13 which may be conveniently of I-section, as indicated in FIG. 5. The stand may comprise a third section 14, shown in FIGS. 1 and 3 and similar in constructing to sections 11 and 12, supported at its forward end by rollers 15 on rails 16 resting on ground surface 17. The upper rear end of stand 10 is prefereably pivotally supported at a fixed distance above the ground, for example, as by being secured to the wall of a gymnasium or other enclosure, such a wall being indicated at 18. Brackets 19 affixed in any suitable way to wall 18 and the stand is pivotally secured to such brackets as by means of hinge pins 21 which pass through registered openings in the brackets and in horizontal support beams 22 which are rigidly secured as by welding to the rearward ends of the beams of upper frame section 12.

Rollers 15 at the forward end of stand sections 14 are supported on beams 23 which are rigidly secured as by welding to the forward end of section 14. Longitudinal beams 13 of the sections may be interconnected by cross beams 24 of channel-section, and upper decks 25, 26, 27 span the beams of the stand sections and are welded or otherwise connected to the longitudinal beams. Each of the decks has foot rests 28 and risers 29 to which seats 31 may be welded or otherwise connected.

Stand sections 11 and 14 are horizontally hinged together at their adjacent ends by means of hinge arms 32, 33 respectively secured at one end to the stand sections and hingedly interconnected as at 34, and further hinge arms 35, 36 respectively hinged to arms 32, 33 at 37, 38, and hingedly interconnected at 39. A hydraulically extendable/retractable strut 40 is pivotally connected at 34 and 39 and is actuated when folding the stand to its FIG. 3 position.

Figures 1, 2:
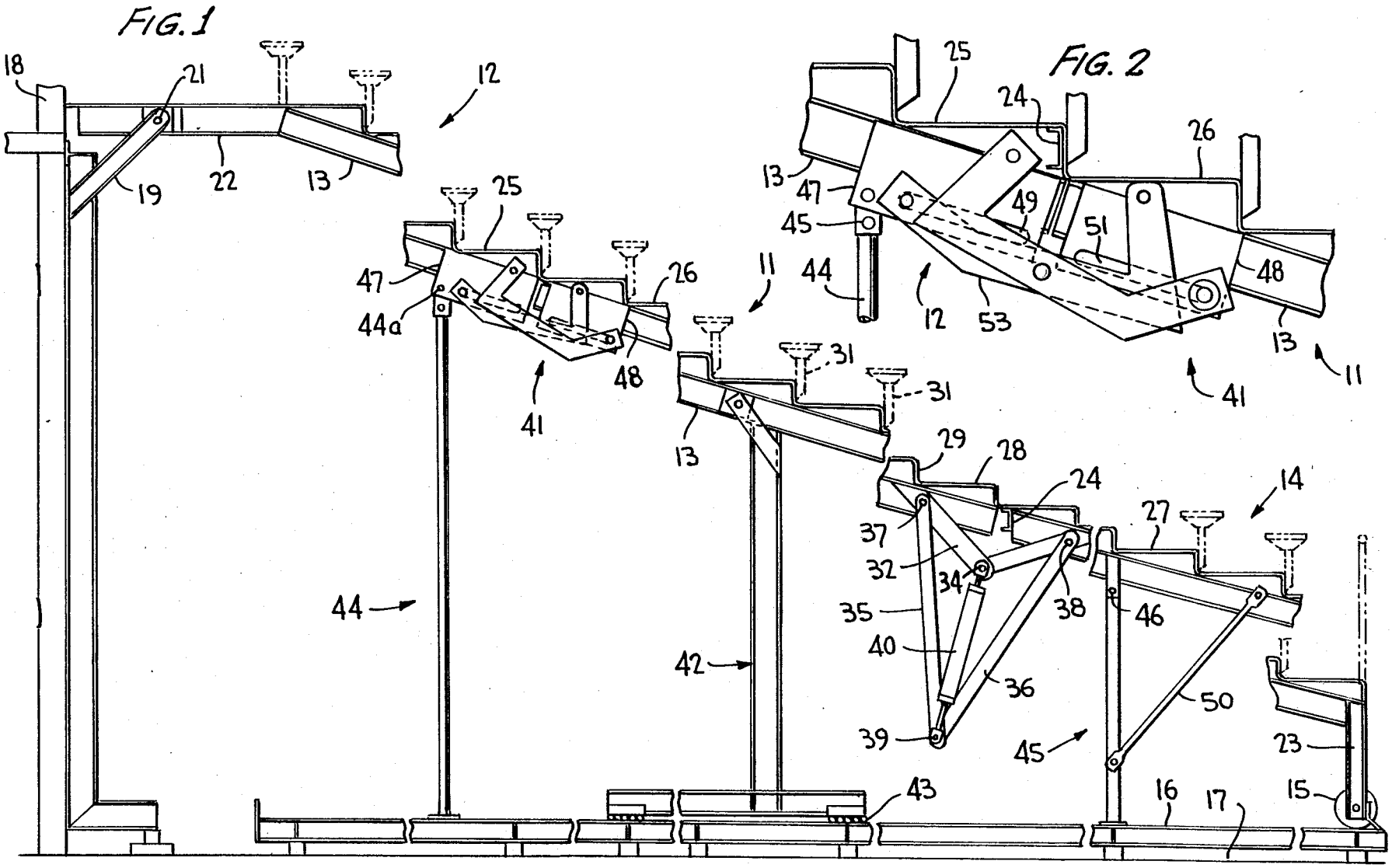
FIG. 1 is a side elevational view, partly broken away, of a folding grandstand according to the invention shown when fully opened.
Figure 4:
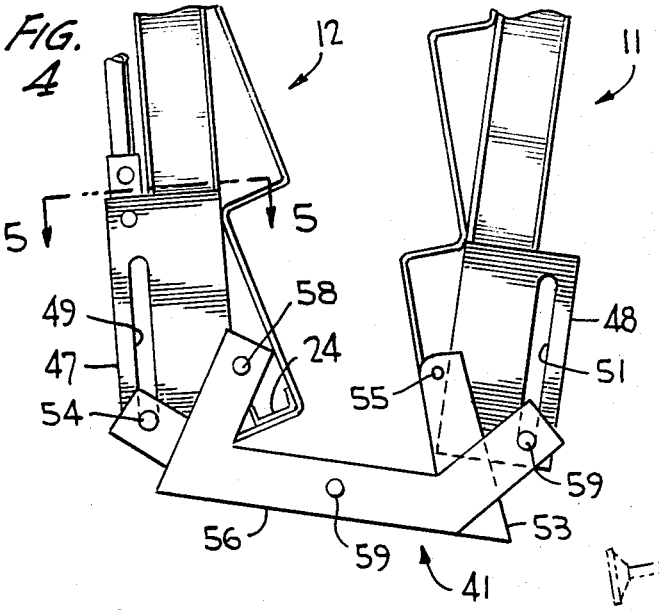
FIG. 4 is a view similar to FIG. 1 at an enlarged scale of the link hinge assembly connecting forward and rearward grandstand sections.

Stand sections 11 and 12 are hinged together at adjacent ends by link hinge assemblies 41, shown in detail in FIGS. 2 and 4.

Stand section 11 may be supported by one or more wheeled carriages or dollies 42 which may comprise generally trapezoidal frames of substantially vertical side posts interconnected by cross bracings and resting upon base blocks supporting rollers 43. The dolly may be structured similarly as that detailed in my prior U.S. Pat. No. 2,817,121 specifically incorporated herein by reference. The rollers are guided along rails 16 when the stand is collapsed to its FIG. 3 position.

The principle support for the live load of the stand is afforded by one or more leg frames 44 which may be of general rectangular configuration having side posts, a top cross bar and a foot portion, the frame being cross-braced, and hinged at 45 to the link hinge assembly 41. The foot support of the leg frame rests against the upper side of rails 16 in the FIG. 1 open position of the stand.

And, the leg frames 44 may be structured as detailed in my prior U.S. Pat. No. 2,817,121.

Stand section 14 may be supported by a leg frame 45 structured similarly as leg frame 44, hinged at 46 stand section 14 and having a foot resting against rails 16 in the FIG. 1 open position of the stand. A support strut 50 is removably linked to leg frame 44 and is hinged to section 14.

Link hinge assembly 41 according to the invention comprises flat hinge plates 47 and 48 respectively secured to longitudinal frames 13 of stand sections 12 and 11. Each plate has an elongated slot 49, 51 lying parallel to beams 13. A lever arm 53 is connected at one end to a hinge pin 54 extending through slot 49 for sliding movement therealong. The other end of arm 53 is pivotally connected to pin 55 welded or otherwise secured to the upper face of beam 13 of section 11.

Another lever arm 56 overlies arm 53 and has a washer 57 welded to its inner face. One end of arm 56 is pivotally connected to a hinge pin 58 welded to the upper face of beam 13 of stand section 12 (see also FIG. 5). The opposite end of arm 56 likewise has a washer (not shown) welded to its inner face and is hingedly connected to a pin 59 extending through slot 51 for sliding movement therealong.

Another link hinge assembly 41' is mounted at the opposite side of beams 13, as shown in FIG. 5 in which the elements of assembly 41' are the same as element 41 and are designated with a prime, and hinge pins 54, 58, 55 and 59 are common to both link assemblies 41 and 41'.

The lever arms of the opposing hinge assemblies lie wholly beneath the decks 25 and 26 so as to be recessed below the deck surfaces of the grandstand sections.

Figure 3:
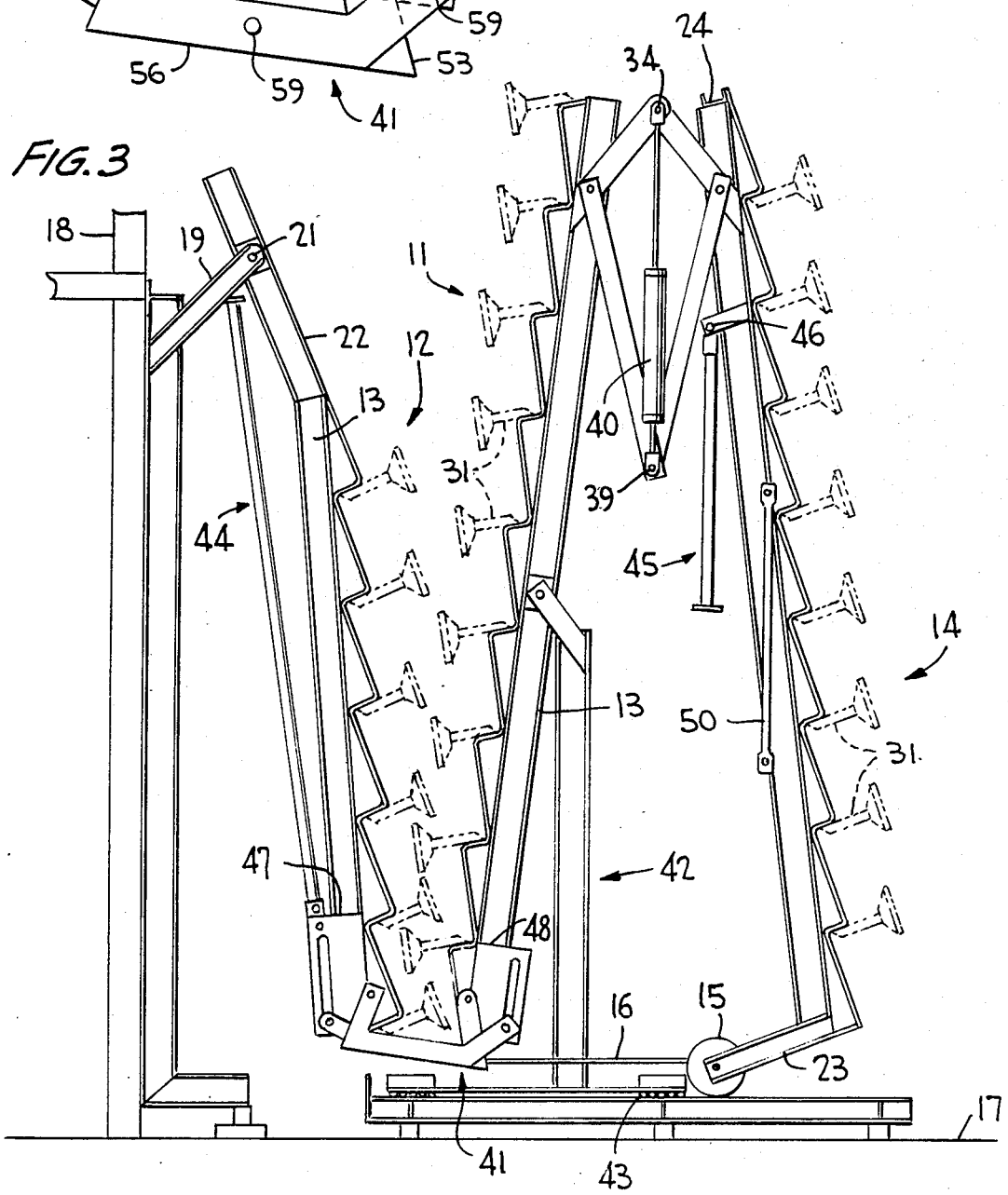
FIG. 3 is a view similar to FIG. 1 of the grandstand shown folded into a substantially vertical position.

For collapsing the folding grandstand into its FIG. 3 storage position, the lower pin of brace 50 is removed, and hydraulic struts 40 are extended for breaking the knee joint between sections 11 and 14 of the stand whereupon the three stand sections are fan folded as shown. Prior to folding, leg frame 44 is pivoted upwardly and rearwardly about its pivot **44*a*, rollers 15 are guided along rails 16, and rollers 43 of dolly 42 are likewise guided along the rails. During folding of the grandstand, hinge pins 54 and 59 of hinge assemblies 41, 41' slide along their respective slots 49 and 51 between the FIGS. 2 and 4 positions, whereupon lever arms 53, 53' and 56, 56' pivot at opposite ends about their hinge pins permitting stand sections 12 and 11** to spread apart at their adjacent ends.

On opening the grandstand back to its FIG. 1 position, section 14 is rolled at its forward end along the rails while hydraulic struts 40 are retracted whereupon dolly 42 is guided along the rails, and leg frames 44 and 45 are repositioned vertically.

From the foregoing, it can be seen that the folding grandstand according to the invention is highly versatile in that link hinge assemblies 41, 41' avoid any interference with the seat occupants and may therefore be positioned at other than side or end aisles as before. Moreover, since the link hinge assemblies are recessed, they need not be greased and covered. The link hinge assemblies are moreover of simpler construction, are more reliable and are easier to maintain.

Obviously, many other modifications and variations of the present invention are made possible in the light of the above teachings. It is therefore to be understood that within the scope of the apended claims the invention may be practiced otherwise than as specifically described.

What is claimed is:

1. A folding grandstand comprising, a supporting frame comprising at least a forward and a rearward section horizontally hinged together at their adjacent ends, the frame adapted when opened for use to occupy a plane of gradual inclination to the horizontal, means supporting the forward section on a ground surface, means hingedly supporting an upper end of the rearward section to an upstanding wall, said sections having an upper deck surface, a link hinge assembly for hinging said adjacent ends of said sections together, said assembly comprising a pair of flat hinge plates respectively fixed to said sections, each of said plates having an elongated slot lying parallel to said respective sections, a pair of lever arms each hingedly connected at one end thereof to said respective sections, an opposite end of each of said arms being pivotally connected to an opposing one of said plates for sliding movement along said slot thereof upon a folding of said sections at said hinge assembly, said arms being hingedly interconnected intermediate said ends thereof, and said lever arms lying wholly beneath said deck surface of each said section, whereby said link hinge assembly avoids any interference with and contact by seat occupants of the grandstand.

2. The grandstand according to claim 1, wherein said frame further comprises a third section horizontally hinged at a rearward end thereof to a forward end of said forward section, said third section comprising said means supporting said forward section on the ground surface.

* * * * *